US008763576B2

(12) United States Patent
Kato

(10) Patent No.: US 8,763,576 B2
(45) Date of Patent: Jul. 1, 2014

(54) ROCKER ARM WITH LASH ADJUSTER

(71) Applicant: OTICS Corporation, Nishio (JP)

(72) Inventor: Yuji Kato, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 0 days.

(21) Appl. No.: 13/887,151

(22) Filed: May 3, 2013

(65) Prior Publication Data

US 2013/0306016 A1 Nov. 21, 2013

(30) Foreign Application Priority Data

May 21, 2012 (JP) ..... 2012-115514

(51) Int. Cl.
*F01L 1/34* (2006.01)

(52) U.S. Cl.
USPC ..... 123/90.45; 123/90.39; 123/90.52

(58) Field of Classification Search
USPC ..... 123/90.39, 90.52, 90.43, 90.45, 90.59
See application file for complete search history.

(56) References Cited

U.S. PATENT DOCUMENTS 5,325,825 A 7/1994 Schmidt et al.
6,425,361 B1 * 7/2002 Motohashi ..... 123/90.41

* cited by examiner

*Primary Examiner* — Zelalem Eshete
(74) *Attorney, Agent, or Firm* — McGinn IP Law Group, PLLC

(57) ABSTRACT

The present invention provides a rocker arm with a lash adjuster which includes a rocker arm body portion including a circular fitting hole, a large-diameter hole, and a step portion at a boundary between the fitting hole and the large-diameter hole; a lash adjuster having a snap ring groove formed on an outer circumferential surface of the lash adjuster, and a snap ring fitted to the snap ring groove, wherein the lash adjuster is inserted in the fitting hole, the snap ring increases in diameter, hooks on the step portion, and prevents the lash adjuster from slipping off; and a diameter-reducing member that is assembled in the rocker arm body portion and that reduces the diameter of the snap ring by operation of the diameter-reducing member from an outside of the rocker arm body portion until the snap ring is not engaged with the step portion.

9 Claims, 8 Drawing Sheets

ROCKER ARM WITH LASH ADJUSTER

TECHNICAL FIELD

The present invention relates to a rocker arm, to which a lash adjuster is assembled, in a valve mechanism for an internal combustion engine.

BACKGROUND ART

There has been suggested a rocker arm 95 that is rockably supported by a rocker shaft 99 and that is assembled such that a lash adjuster 90 that adjusts a valve clearance is fitted in a fitting hole 96 provided in a closed-end hole shape as shown in FIG. 8 (Patent Literature 1).

The lash adjuster 90 is prevented from slipping off from the fitting hole 96 by bringing the distal end of a plunger 91 into contact with an inner bottom face 97 of the fitting hole 96 and increasing the diameter of a snap ring 94 inside a large-diameter portion 98. The snap ring 94 is fitted in a snap ring groove 93 provided in the outer circumferential surface of a body 92. The large-diameter portion 98 is formed at the bottom side of the fitting hole 96.

CITATION LIST

Patent Literature

Patent Literature 1: U.S. Pat. No. 5,325,825

SUMMARY OF INVENTION

Technical Problem

However, the snap ring 94 that has been once increased in diameter inside the large-diameter portion 98 cannot be operated from the outside of the rocker arm 95, so it is not possible to reduce the diameter of the snap ring 94. Therefore, the lash adjuster 90 assembled to the rocker arm 95 cannot be removed from the rocker arm 95, so it is not possible to adjust or replace the lash adjuster 90 after assembling the lash adjuster 90.

It is an object of the present invention to provide a rocker arm with a lash adjuster, which allows the assembled lash adjuster to be easily removed.

Solution to Problem

To achieve the object described above, a rocker arm with a lash adjuster of the present invention includes: a rocker arm body portion including a circular fitting hole, a large-diameter hole that is formed on a bottom side of the fitting hole and that has an inside diameter larger than that of the fitting hole, and a step portion at a boundary between the fitting hole and the large-diameter hole; a lash adjuster having a snap ring groove formed on an outer circumferential surface of the lash adjuster so as to extend in a circumferential direction, and a partially cut-out annular snap ring fitted to the snap ring groove, wherein once the lash adjuster is inserted in the fitting hole, the snap ring reduces in diameter against elastic force when the snap ring passes through the fitting hole while being fitted to the snap ring groove, the snap ring increases in diameter by elastic force when the snap ring reaches the large-diameter hole and hooks on the step portion while being fitted to the snap ring groove, and the snap ring prevents the lash adjuster from slipping off; and a diameter-reducing member that is a member engaged with the snap ring, that is assembled in the rocker arm body portion and that reduces the diameter of the snap ring by operation of the diameter-reducing member from an outside of the rocker arm body portion until the snap ring is not engaged with the step portion.

A form of the diameter-reducing member is not specifically limited; however, a rotator, or the like, that rotates through operation from an outside of the rocker arm body portion may be an example. In order to make it possible to perform rotation through operation from the outside of the rocker arm body portion with the use of a jig such as a hexagonal wrench, it is preferable that an engaging portion with which a jig for the operation is engaged be provided at a portion of the diameter-reducing member, which is exposed from the rocker arm body portion.

A form of the snap ring is not specifically limited; however, the snap ring may have a circular annular shape or may have a deformed annular shape other than the circular annular shape. In the case of the circular annular shape, the fitting portion that is fitted to the snap ring groove is formed on a relatively inner side in the radial direction of the snap ring, and the protruding portion that protrudes from the snap ring groove and that is hooked on the step portion is formed on a relatively outer side in the radial direction of the snap ring. On the other hand, in the case of the deformed annular shape other than the circular annular shape, the fitting portion and the protruding portion are formed in the circumferential direction of the snap ring. However, the protruding portion may also be formed on an outer side of the fitting portion (on an outer side in the radial direction of the snap ring). It is preferable that the snap ring have the deformed annular shape other than the circular annular shape, because the protruding portion can be increased in size (a radial distance of the snap ring that protrudes from the snap ring groove can be increased), so the snap ring is less likely to be disengaged from the step portion even when the snap ring is reduced in diameter during usage.

The deformed annular shape other than the circular annular shape is not specifically limited; however, it may be, for example, an elliptical annular shape, an oblong annular shape, a polygonal annular shape having curved edges, or the like. Preferably, the deformed annular shape other than the circular annular shape is the elliptical annular shape or oblong annular shape, because it is possible to easily reduce the diameter of the snap ring through operation of the diameter-reducing member until the snap ring is disengaged from the step portion, and it is possible to increase the size of the protruding portion.

When the diameter-reducing member is the rotator, a form may be exemplified in which one end portion of the snap ring is engaged with the rotator and the other end of the snap ring is engaged with the lash adjuster. In this case, a form may be exemplified in which the one end portion is bent in an axial direction of the lash adjuster and extends in the axial direction and the one end portion is engaged with the rotator so as to be disengageable from the rotator through a relative displacement in the axial direction between the rotator and the lash adjuster.

Advantageous Effects of Invention

According to the present invention, it is possible to provide a rocker arm with a lash adjuster, which allows the assembled lash adjuster to be easily removed.

DESCRIPTION OF EMBODIMENTS

Embodiment

A rocker arm 10 with a lash adjuster according to an embodiment of the present invention will be described with reference to FIG. 1 to FIG. 7B.

Figure 1:
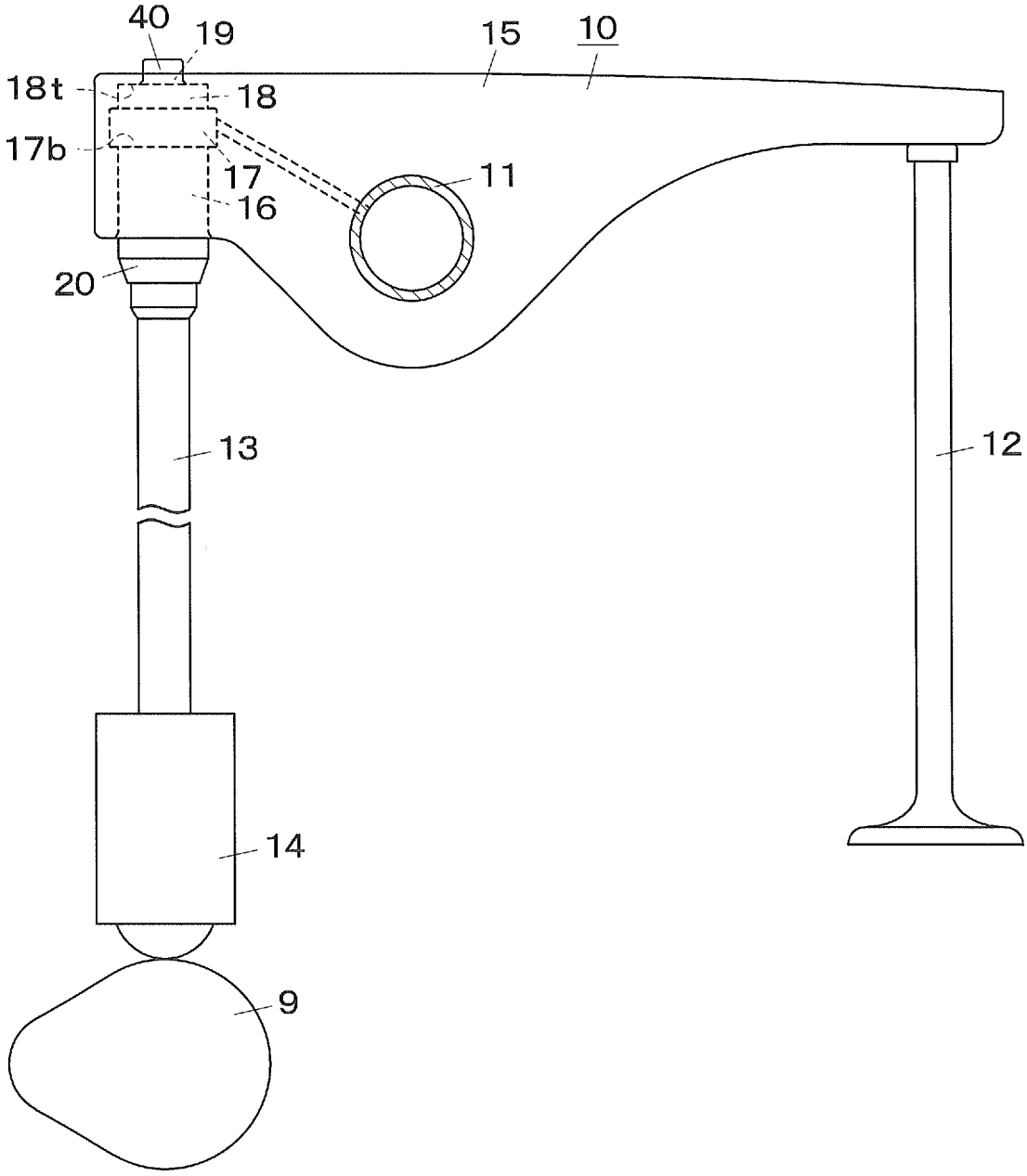
FIG. 1 is a front view of a rocker arm with a lash adjuster according to an embodiment of the present invention.
Figure 2:
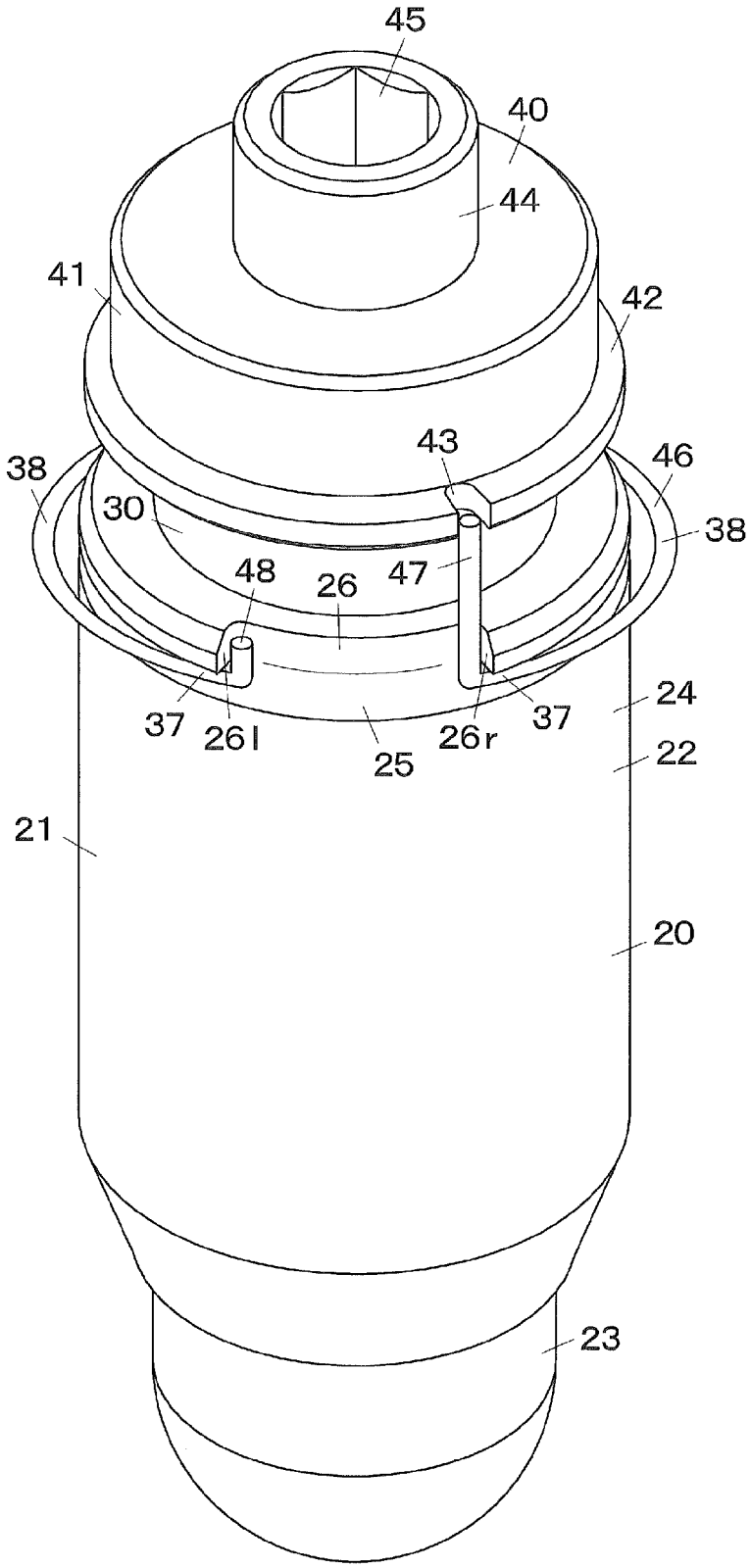
FIG. 2 is a perspective view of the lash adjuster of the rocker arm with the lash adjuster, in which a rotator and a snap ring are attached to the lash adjuster.
Figure 3:
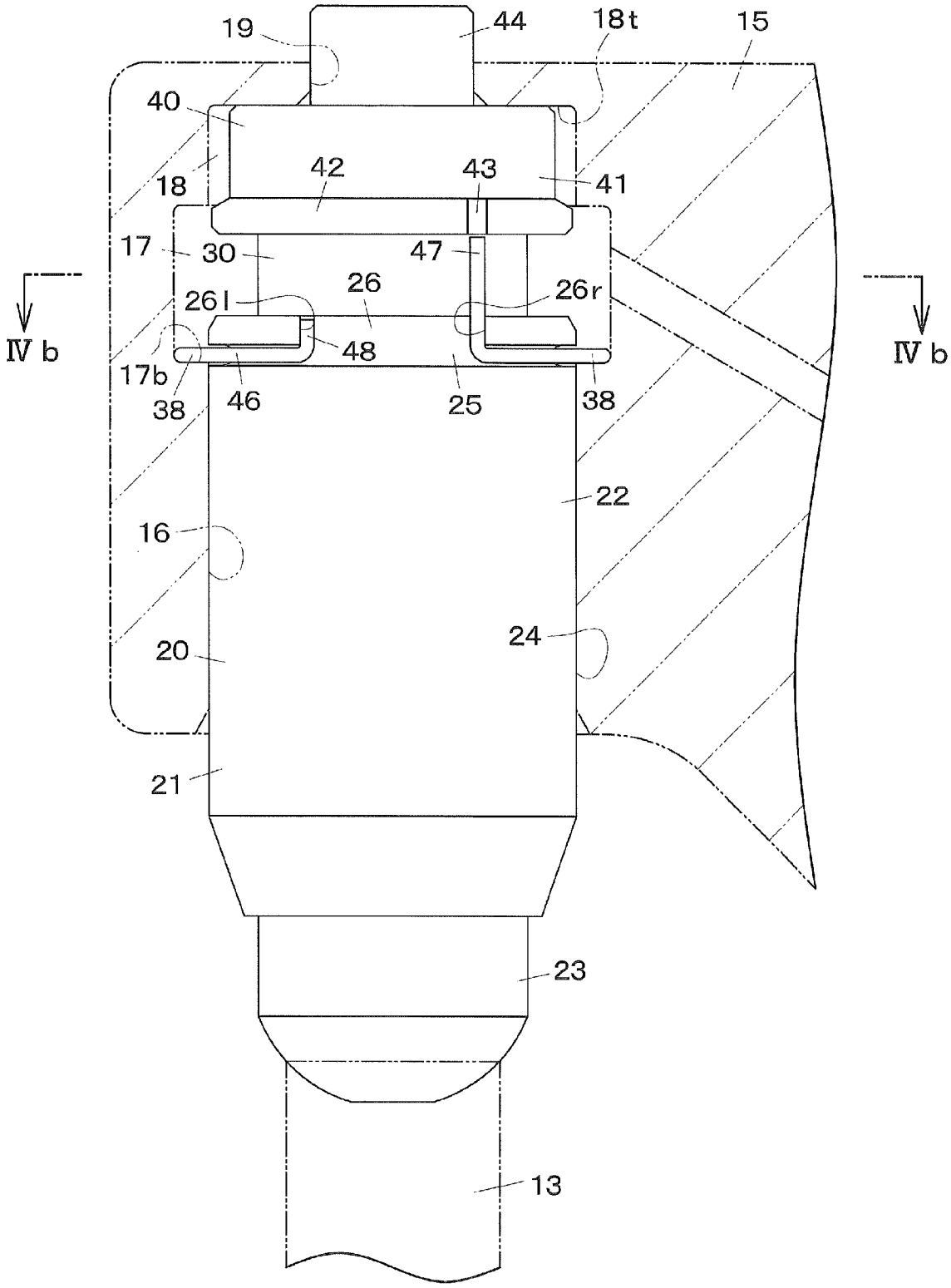
FIG. 3 is a front view of the lash adjuster.
Figure 4A:
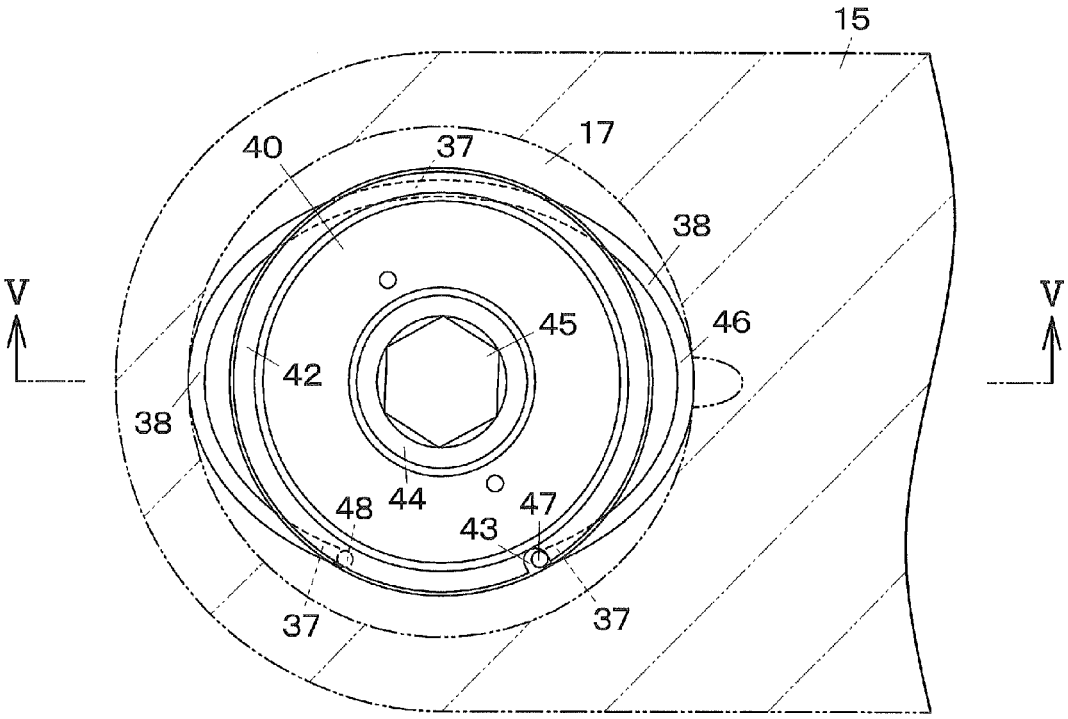
FIG. 4A is a plan view of the lash adjuster.
Figure 4B:
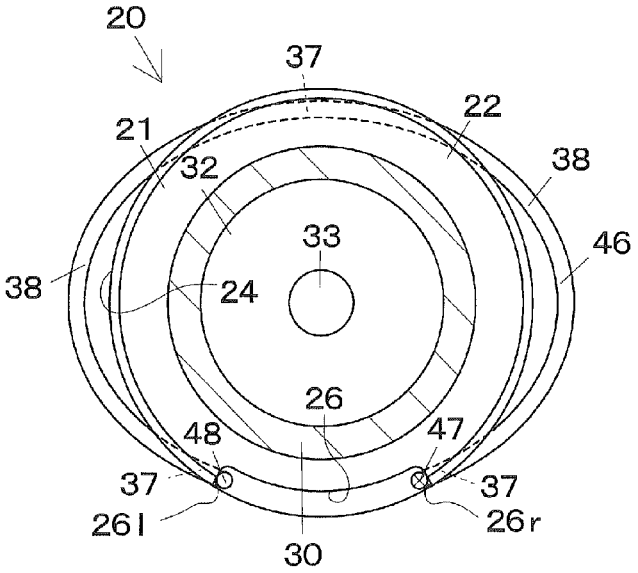
FIG. 4B is a cross-sectional view taken in a horizontal direction.
Figure 5:
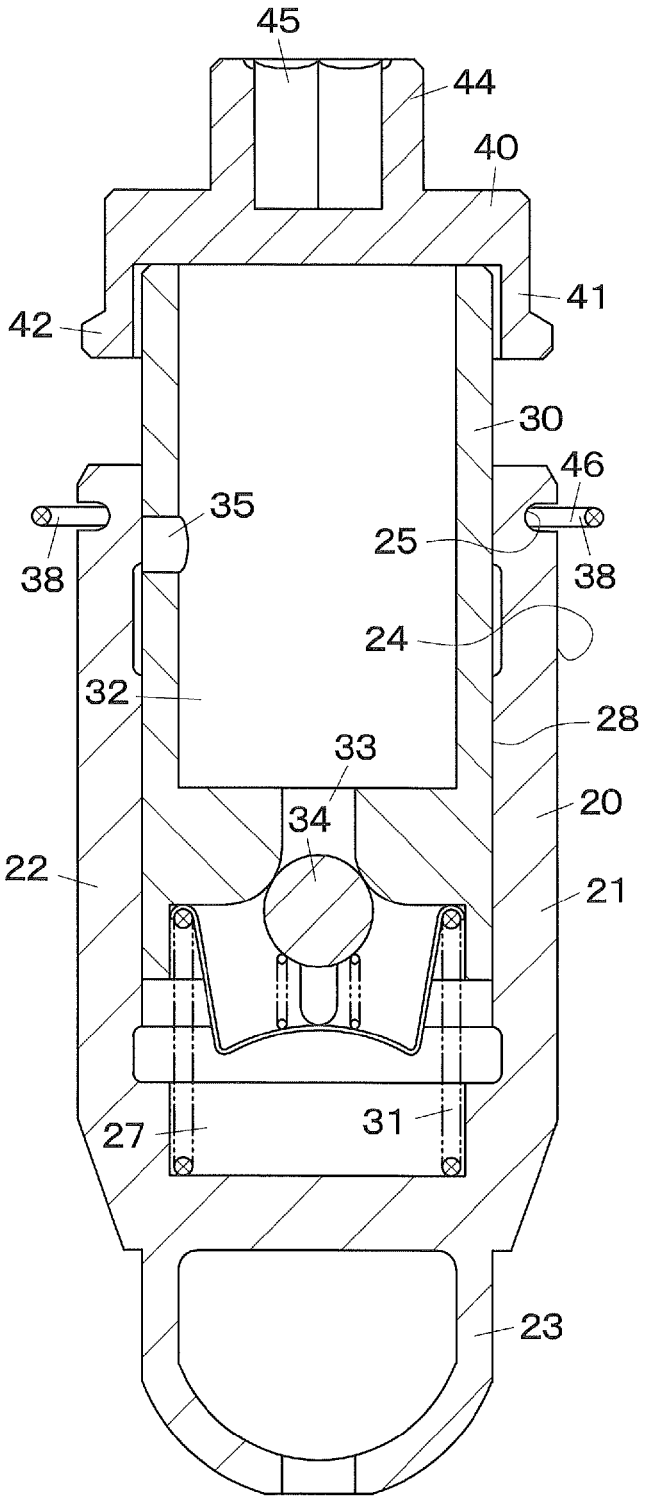
FIG. 5 is a sectional view taken in a longitudinal direction of the lash adjuster.
Figure 6:
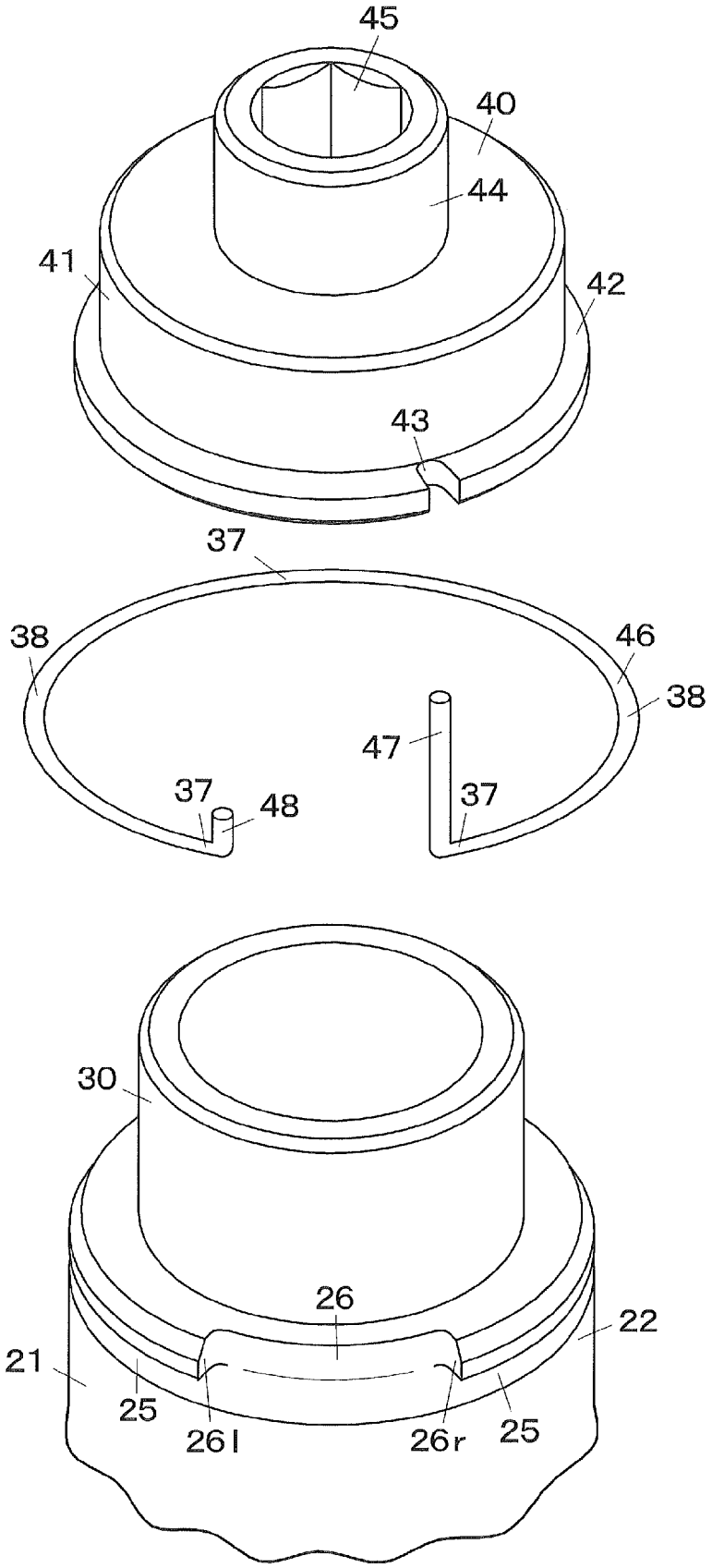
FIG. 6 is an exploded perspective view of a relevant portion of the lash adjuster, the rotator and the snap ring.

The rocker arm 10 with the lash adjuster includes a rocker arm body portion 15, the lash adjuster 20, a rotator 40 and a snap ring 46. As shown in FIG. 1, the rocker arm body portion 15 is rockably supported at its intermediate portion by a rocker shaft 11. One end portion of the rocker arm body portion 15 is in contact with a valve 12. The other end portion of the rocker arm body portion 15 is in contact with the distal end of a push rod 13 via the lash adjuster 20 assembled to the other end portion. The push rod 13 extends from a roller tappet 14 that is in contact with a cam 9. The rocker arm 10 with the lash adjuster opens or closes the valve 12 in accordance with rotation of the cam 9, and adjusts a valve clearance of the valve 12 with the use of the lash adjuster 20.

A circular fitting hole 16 for fitting the lash adjuster 20 is provided at the other end portion of the rocker arm body portion 15. The fitting hole 16 opens at the lower face of the rocker arm body portion 15, and extends upward. A circular large-diameter hole 17 having a larger inside diameter than the fitting hole 16 is formed on a bottom side of the fitting hole 16. A bottom hole 18 for assembling the rotator 40 is formed on a bottom side of the large-diameter hole 17. The bottom hole 18 has a circular closed-end hole shape having substantially the same inside diameter as the fitting hole 16. The fitting hole 16, the large-diameter hole 17 and the bottom hole 18 communicate with one another. A lower face 17*b* of the large-diameter hole 17 serves as a step portion. A through-hole 19 that extends to the upper face of the rocker arm body portion 15 is provided through an inner bottom face 18*t* of the bottom hole 18.

As shown in FIG. 2 to FIG. 7B, the lash adjuster 20 includes a body 21 and a plunger 30. The body 21 has a cylindrical portion 22 having a generally bottomed cylindrical shape. The proximal portion of the plunger 30 is inserted in the cylindrical portion 22 so as to be slidable in the axial direction of the lash adjuster 20. The rotator 40 is provided at the distal end of the plunger 30. The snap ring 46 is fitted to a snap ring groove 25 provided in the cylindrical portion 22.

The body 21 is formed of a cylindrical portion 22 and a protruding portion 23. The cylindrical portion 22 has a generally bottomed cylindrical shape and opens upward. The protruding portion 23 protrudes downward from the cylindrical portion 22, and the lower face of the protruding portion 23 has a generally semispherical shape. The body 21 is inserted in the fitting hole 16 such that the cylindrical portion 22 is able to slide in the up-and-down direction inside the fitting hole 16. An outer circumferential surface 24 at the upper portion of the cylindrical portion 22 is provided with the snap ring groove 25. The snap ring groove 25 extends in the circumferential direction of the cylindrical portion 22 over all around the outer circumferential surface 24. A cutout portion 26 is partially formed between the upper end of the cylindrical portion 22 and the snap ring groove 25. The cutout portion 26 is formed by cutting out the cylindrical portion 22 to the upper end of the cylindrical portion 22 at substantially the same depth as the snap ring groove 25. The protruding portion 23 is engaged with a recessed portion at the distal end of the push rod 13. A high-pressure hydraulic chamber 27 and a small clearance 28 are formed between the internal space of the cylindrical portion 22 and the plunger 30 inserted in the internal space. The small clearance 28 is used to leak oil inside the high-pressure hydraulic chamber 27.

The body 21 adjusts the valve clearance of the valve 12 by moving inside the fitting hole 16 in a direction in which the body 21 is inserted or removed, that is, in the up-and-down direction.

The plunger 30 has a generally bottomed cylindrical shape and opens upward. The plunger 30 is urged upward by a spring 31 provided in the high-pressure hydraulic chamber 27, and the distal end of the plunger 30 contacts the inner bottom face 18*t* of the bottom hole 18 via the rotator 40. A low-pressure hydraulic chamber 32 is formed in the internal space of the plunger 30. A supply hole 35 for supplying oil to the low-pressure hydraulic chamber 32 is provided at the peripheral portion of the plunger 30. A communication hole 33 for supplying oil from the low-pressure hydraulic chamber 32 to the high-pressure hydraulic chamber 27 is provided at the bottom portion of the plunger 30. The communication hole 33 prevents back flow of oil from the high-pressure hydraulic chamber 27 to the low-pressure hydraulic chamber 32 with the use of a check valve 34 provided in the high-pressure hydraulic chamber 27.

When the body 21 has moved upward inside the fitting hole 16, the distal end of the plunger 30 is in contact with the inner bottom face 18*t* of the bottom hole 18, so the plunger 30 cannot move, and a portion of the plunger 30, which is inserted in the body 21, increases. On the other hand, when the body 21 has moved downward inside the fitting hole 16, the plunger 30 is urged upward by the spring 31, so a portion of the plunger 30, which is inserted in the body 21, reduces without moving the plunger 30.

The rotator 40 is provided inside the bottom hole 18. The rotator 40 has a generally disc shape, and a fitting portion 41 that extends downward is formed along its outer periphery. The fitting portion 41 is externally fitted to the distal end portion of the plunger 30 such that the rotator 40 is rotatable relative to the plunger 30 while using the plunger 30 as a rotary shaft. The rotator 40 is also rotatable relative to the body 21. A flange portion 42 is formed at the lower portion of the fitting portion 41. The flange portion 42 protrudes in the radial direction of the plunger 30. An engaging hole 43 is provided in the flange portion 42. When the snap ring 46 is reduced in diameter, one end portion 47 of the snap ring 46 is engaged with the engaging hole 43. The engaging hole 43 extends through the flange portion 42 in the up-and-down direction, and is open laterally. A columnar protrusion 44 having a generally columnar shape is provided at the substantially center of the upper face of the rotator 40. The columnar protrusion 44 is fitted into the through-hole 19, and protrudes upward from the upper face of the rocker arm body portion

15. An engaging socket 45 for engaging a hexagonal wrench 39 is open at the upper face of the columnar protrusion 44.

The snap ring 46 has a partially cut-out annular shape, and is formed by bending a linear spring steel. More specifically, the snap ring 46 is formed by bending a linear spring steel into an annular shape having a generally elliptical shape of which the major axis is larger than the outside diameter of the cylindrical portion 22 and the minor axis is substantially equal to the outside diameter of a portion of the cylindrical portion 22 at which the snap ring groove 25 is provided. The snap ring 46 has the annular shape in which part of a portion at an intersection with the minor axis is cut out. A fitting portion 37 of the snap ring 46 is fitted to the snap ring groove 25 provided in the cylindrical portion 22. The snap ring 46 has a protruding portion 38 that protrudes from the snap ring groove 25 (protrudes from the outer circumferential surface 24 of the cylindrical portion 22) and that is engaged with the lower face 17*b* of the large-diameter hole 17. Both end portions 47 and 48 of the snap ring 46 are respectively bent upward at substantially a right angle, and extend in the axial direction of the lash adjuster 20. The one end portion 47 of the snap ring 46 extends to near the lower end of the flange portion 42 through the cutout portion 26 while being in contact with a right wall 26*r* of the cutout portion 26. The other end portion 48 of the snap ring 46 extends to near the upper end of the body 21, and is in contact with and engaged with a left wall 261 of the cutout portion 26. When the lash adjuster 20 is inserted into the fitting hole 16, the snap ring 46 is reduced in diameter so as not to protrude from the outer circumferential surface 24 of the cylindrical portion 22 in a state where the snap ring 46 is fitted to the snap ring groove 25.

When the body 21 attempts to move in a direction in which the body 21 slips off from the fitting hole 16, that is, downward, the protruding portion 38 of the snap ring 46 is brought into contact with and hooked on the lower face 17*b* of the large-diameter hole 17, restricts movement of the body 21, and prevents the lash adjuster 20 from slipping off. On the other hand, when the body 21 attempts to move in a direction in which the body 21 is inserted into the fitting hole 16, that is, upward, the snap ring 46 moves together with the body 21.

Operation to remove the assembled lash adjuster 20 from the rocker arm body portion 15 will be described with reference to FIG. 7A and FIG. 7B.

Figure 7A:
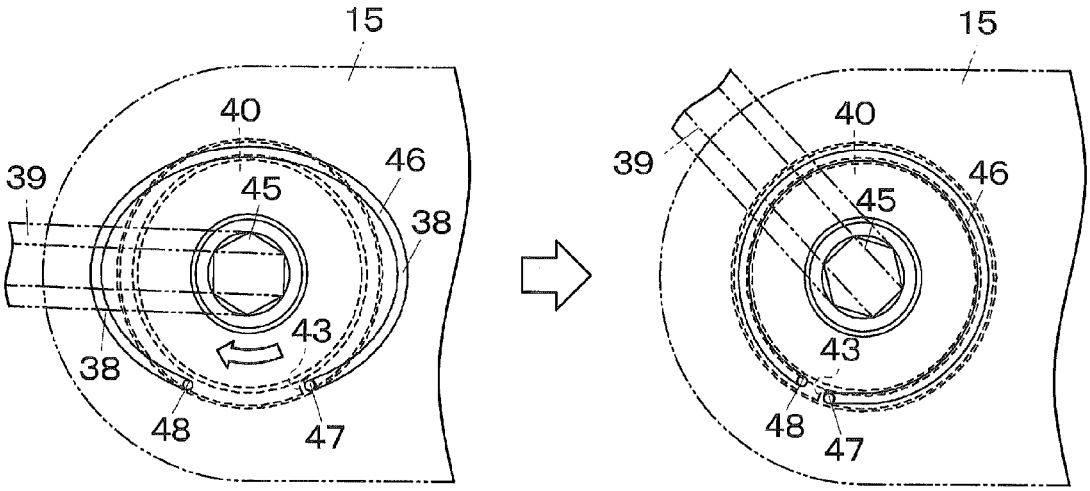
FIG. 7A and FIG. 7B are views that illustrate operation for removing the lash adjuster from a rocker arm body portion.
Figure 7B:
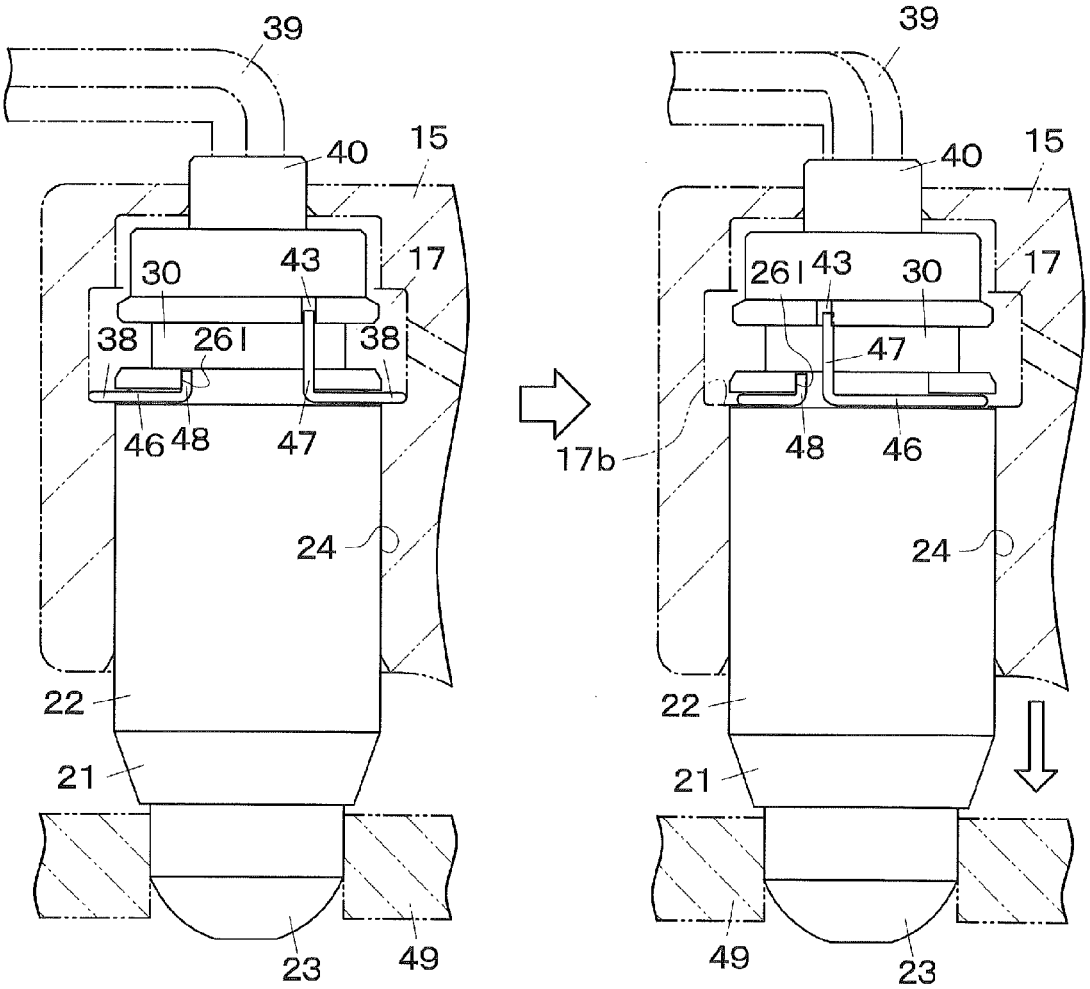
Figure 8:
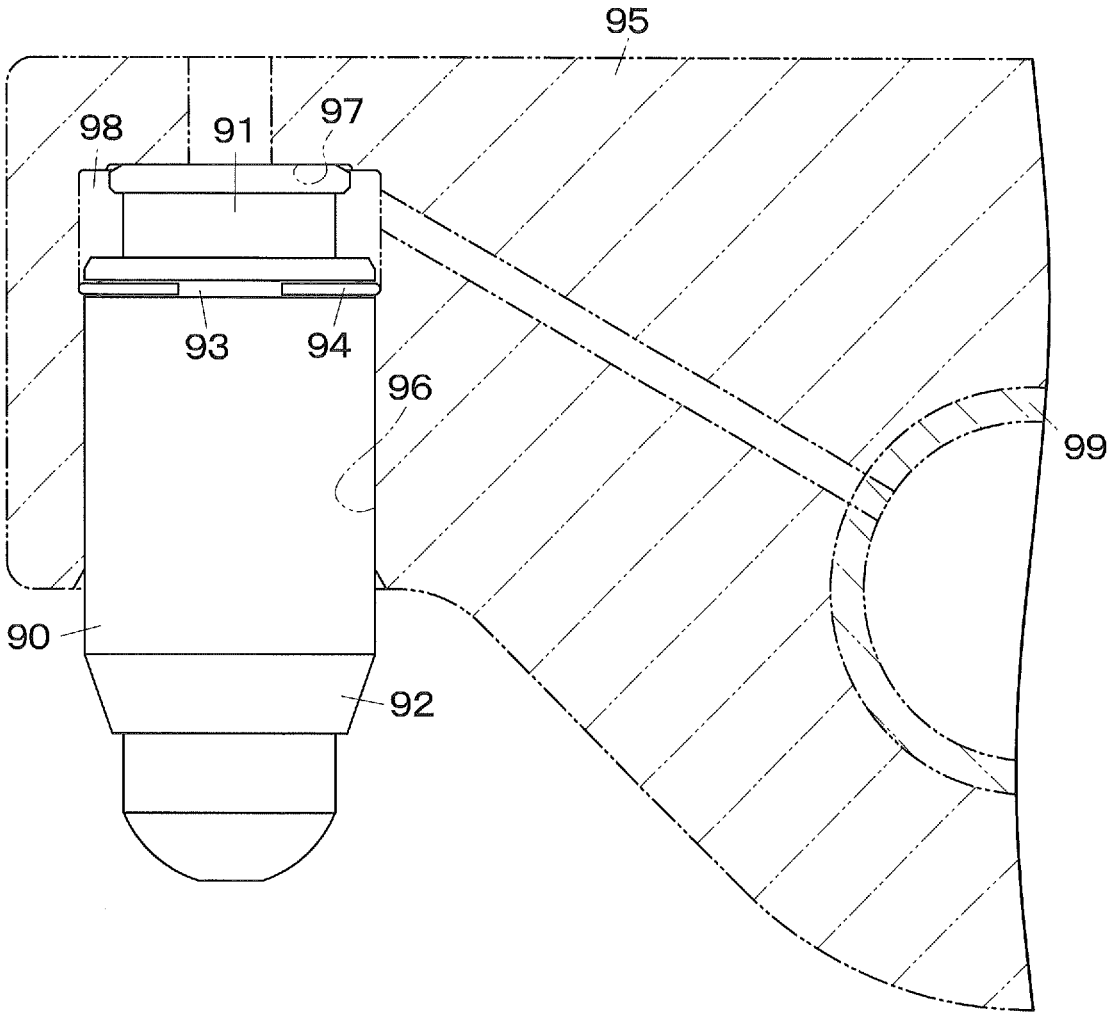
FIG. 8 is a front view of an existing lash adjuster to which a rocker arm is assembled.

First, as shown in the left drawing of FIG. 7B, the body 21 is fixed so as not to rotate by clamping the protruding portion 23 of the body 21 with the use of a fixing jig 49. Then, the rotator 40 is pressed down in the axial direction of the lash adjuster 20, and the one end portion 47 of the snap ring 46 is inserted into the engaging hole 43 of the rotator 40. By so doing, the one end portion 47 is engaged with the rotator 40.

Subsequently, as shown in the left drawings of of FIG. 7A and FIG. 7B, in order to reduce the diameter of the snap ring 46 that is increased in diameter in the large-diameter hole 17 by elastic force, the hexagonal wrench 39 that serves as a jig is engaged with the engaging socket 45, and the rotator 40 is rotated with the use of the hexagonal wrench 39 in a direction indicated by an arrow in the left drawing of FIG. 7A (clockwise direction in plan view). The body 21 is fixed by the fixing jig 49, so the body 21 and the plunger 30 do not rotate at this time. The one end portion 47 of the snap ring 46 is inserted in the engaging hole 43, so the snap ring 46 attempts to rotate along the snap ring groove 25 with the rotation of the rotator 40 as the rotator 40 is rotated. However, the other end portion 48 of the snap ring 46 is in contact with the left wall 261 of the cutout portion 26, so the snap ring 46 cannot rotate, and the one end port ion 47 moves together with the rotator 40. Therefore, the snap ring 46 reduces in diameter against its elastic force.

Then, as shown in the right drawings of FIG. 7A and FIG. 7B, by reducing the diameter of the snap ring 46 so as not to protrude from the outer circumferential surface 24 of the cylindrical portion 22, that is, by eliminating a protruding portion of the snap ring 46, the snap ring 46 does not contact the lower face 17*b* of the large-diameter hole 17, so the snap ring 46 is disengaged from the lower face 17*b* of the large-diameter hole 17. Therefore, the snap ring 46 does not restrict movement of the body 21, and the lash adjuster 20 is ejected from the fitting hole 16 by pressing the rotator 40 downward.

With the rocker arm 10 with the lash adjuster, the following advantageous effects (a) to (g) are obtained.

(a) The lash adjuster 20 is assembled such that the snap ring 46 prevents the lash adjuster 20 from slipping off from the fitting hole 16, so work for assembling the lash adjuster 20 is easy.

(b) By rotating the rotator 40, the snap ring 46 reduces in diameter, and the snap ring 46 is disengaged from the lower face 17*b* of the large-diameter hole 17, so it is possible to easily remove the lash adjuster 20. Therefore, it is possible to adjust the lash adjuster 20 after removing the lash adjuster 20, and it is possible to replace the lash adjuster 20.

(c) The columnar protrusion 44 at which the engaging socket 45 is provided protrudes from the rocker arm body portion 15, so it is possible to easily engage the hexagonal wrench 39 with the engaging socket 45.

(d) It is possible to rotate the rotator 40 easily with the use of the hexagonal wrench 39, so it is possible to easily reduce the diameter of the snap ring 46.

(e) The rotator 40 is fitted to the distal end portion of the plunger 30 so as to be rotatable relative to the plunger 30, so there is no concern that the snap ring 46 reduces in diameter due to rotation of the plunger 30.

(f) Because the snap ring 46 has an elliptical annular shape, the protruding portion 38 is large (a radial distance of the snap ring, protruding from the snap ring groove, is large), the snap ring 46 is less likely to be disengaged from the lower face 17*b* of the large-diameter hole 17 even when the snap ring 46 is slightly reduced in diameter during usage, and it is possible to easily reduce the diameter of the snap ring 46 by rotating the rotator 40 until the snap ring 46 is disengaged from the lower face 17*b*.

(g) Both end portions 47 and 48 of the snap ring 46 are respectively in contact with the right and left walls 26*r* and 261 of the cutout portion 26, so the snap ring 46 is not easily disengaged from the snap ring groove 25.

The present invention is not limited to the above-described embodiment. The present invention may be implemented by appropriately modifying the embodiment without departing from the scope of the invention.

For example, the position at which the fitting hole is provided is changed to the valve side, and the valve is pressed via the lash adjuster.

For example, one end portion of the snap ring is elongated upward, and the snap ring is constantly inserted in the engaging hole of the rotator.

REFERENCE SIGNS LIST

15 rocker arm body portion
16 fitting hole
17 large-diameter hole
17*b* lower face
20 lash adjuster

24 outer circumferential surface
25 snap ring groove
39 hexagonal wrench
40 rotator
44 columnar protrusion
45 engaging socket
46 snap ring
47 one end portion
48 other end portion

The invention claimed is:

1. A rocker arm with a lash adjuster, comprising:

a rocker arm body portion including a circular fitting hole, a large-diameter hole that is formed on a bottom side of the fitting hole and that has an inside diameter larger than that of the fitting hole, and a step portion at a boundary between the fitting hole and the large-diameter hole;

a lash adjuster having a snap ring groove formed on an outer circumferential surface of the lash adjuster so as to extend in a circumferential direction, and a partially cut-out annular snap ring fitted to the snap ring groove, wherein once the lash adjuster is inserted in the fitting hole, the snap ring reduces in diameter against elastic force when the snap ring passes through the fitting hole while being fitted to the snap ring groove, the snap ring increases in diameter by elastic force when the snap ring reaches the large-diameter hole and hooks on the step portion while being fitted to the snap ring groove, and the snap ring prevents the lash adjuster from slipping off; and a diameter-reducing member that is a member engaged with the snap ring, that is assembled in the rocker arm body portion and that reduces the diameter of the snap ring by operation of the diameter-reducing member from an outside of the rocker arm body portion until the snap ring is not engaged with the step portion.

2. The rocker arm according to claim 1, wherein the diameter-reducing member is a rotator that is assembled so as to rotate through the operation, and one end portion of the snap ring is engaged with the rotator, and the other end portion of the snap ring is engaged with the lash adjuster.

3. The rocker arm according to claim 2, wherein the one end portion of the snap ring is bent in an axial direction of the lash adjuster and extends in the axial direction, and is engaged with the rotator so as to be disengageable from the rotator through a relative displacement in the axial direction between the rotator and the lash adjuster.

4. The rocker arm according to claim 1, wherein an engaging portion with which a jig for the operation is engaged is provided at a portion of the diameter-reducing member, which is exposed from the rocker arm body portion.

5. The rocker arm according to claim 1, wherein the snap ring is formed in a deformed annular shape other than a circular annular shape.

6. The rocker arm according to claim 3, wherein an engaging hole for engaging with the one end portion of the snap ring is provided in the rotator.

7. The rocker arm according to claim 6, wherein the engaging hole is formed so as to extend through a flange portion in an up-and-down direction, the flange portion being formed in the rotator.

8. The rocker arm according to claim 7, wherein the engaging hole is open laterally.

9. The rocker arm according to claim 5, wherein the snap ring is formed into an elliptical annular shape, and has a partially cut-out annular shape in which part of the snap ring around an intersection with a minor axis of the elliptical shape is cut out.

* * * * *